US005671192A

United States Patent [19]

Schaffel

[11] Patent Number: 5,671,192

[45] Date of Patent: Sep. 23, 1997

[54] RADIO-CONTROLLED CLOCKWORK

[76] Inventor: Fritz Schaffel, Schleissheimer Strasse 12, D-85386, Eching, Germany

[21] Appl. No.: 424,308

[22] PCT Filed: Oct. 27, 1993

[86] PCT No.: PCT/EP93/02983

§ 371 Date: Apr. 26, 1995

§ 102(e) Date: Apr. 26, 1995

[87] PCT Pub. No.: WO94/10612

PCT Pub. Date: May 11, 1994

[30] Foreign Application Priority Data

Oct. 31, 1992 [DE] Germany ..... 42 36 903.7

[51] Int. Cl.[6] ..... G04C 11/02

[52] U.S. Cl. ..... 368/47; 368/80; 368/228

[58] Field of Search ..... 368/47, 49, 60

[56] References Cited

U.S. PATENT DOCUMENTS 5,077,706 12/1991 Ganter ..... 368/47

5,231,612 7/1993 Allgaier et al. ..... 368/47

5,363,348 11/1994 Damle ..... 368/47

FOREIGN PATENT DOCUMENTS 0204851 12/1986 European Pat. Off. .

0372432 6/1990 European Pat. Off. .

*Primary Examiner*—Bernard Roskoski

*Attorney, Agent, or Firm*—Pearne, Gordon, McCoy & Granger LLP

[57] ABSTRACT

A radio-controlled, analog display clockwork has at least two pointers and is driven by an electric driving arrangement. A pointer setting arrangement is provided for the user to bring the pointers of the clockwork to a predetermined position which corresponds to a certain time. Starting from said predetermined pointer position, the control device applies control signals to the driving arrangement, causing the pointers to move more quickly until they have reached a position which corresponds to the instantaneous time.

19 Claims, 3 Drawing Sheets

RADIO-CONTROLLED CLOCKWORK

The present invention relates to a radio-controlled clockwork with at least two pointers, a procedure for setting and using such a clockwork.

In most countries the time is standardized by radio signals, transmitted from a central radio station. In the Federal Republic of Germany the standard time is supplied from an atomic clock of "Physikalisch-technische Bundesanstalt" (federal institution for Physics and Technology), controlling the transmission of time signals via a long-wave transmitter.

Prior art are so-called radio-controlled clocks, which can also be used privately, processing the signals of this long-wave transmitter and therefore always giving the exact time. In general these clocks work with a digital display using light emitting diodes or liquid crystals. For example, such a clock has become prior art by DE 28 02 040 A1.

For some time radio-controlled clocks have become prior art, working in an analog way, i.e. a clockface with two or three pointers is used for display.

In case of such clocks the setting of the time requires a particularly constructive solution, i.e. for the first operation of the clock, e.g. after a battery change, and when setting the clock in case major time differences have to be bridged, as is the case when changing from summer time to winter time and vice versa.

Radio-controlled clocks are controlled by a control device, receiving the time signals from a radio receiving station. In order to move the pointers into the correct position on the basis of the signals received, this control device has to receive an information stating in which position the pointers are at the moment. Therefore arrangements for recognizing the pointer position have to be provided.

In general the pointer position recognition is performed in such a way that in the driving wheels, attributed to the individual pointers, a special position is defined, e.g. by a bore, acting together with an adequate sensor arrangement, e.g. a light barrier. Normally the bores are provided such that the pointers are exactly in the 12 o'clock position when the light of the light barrier meets the bore.

As soon as the clock shall be set anew, these driving wheels will be moved until they reach this defined position and subsequently they will be moved to a pointer position corresponding to the instantaneous time.

From the book "Radio-controlled clocks" by Wolfgang Hilberg (publisher), published in 1983 in Munich and Vienna, pages 104–109, a radio-controlled clock according to the generic term of claim 1 is prior art. In this radio-controlled clock a reflection light barrier is used to determine the pointer position. The procedure described for setting the clockwork provides for a setting procedure started with an electric switching arrangement, moving the pointers until their position has been determined by the reflection light barrier and then the pointers will be moved out of this position at a speed higher than during normal clockwork operation, the number of current impulses being counted, which will be supplied to a driving arrangement for moving the pointers. The setting procedure will be stopped as soon as the number of transmitted impulses corresponds to the number of impulses required for reaching the instantaneous time. This instantaneous time will be determined by evaluating the time signals received by a radio receiver. The clock includes a step motor for the hour pointer and a step motor for the minute pointer.

The setting procedure is relatively unproblematic, if the clock comprises two or three motors as in the embodiment described. However, such clockworks have an expensive design and require much space. In addition they consume a lot of energy. Therefore the use of smaller clocks, e.g. wrist watches, is normally excluded.

In case of clockworks comprising only one motor, the arrangements for recognizing the pointer positions are very expensive with regard to manufacture and space requirements as compared to the remaining design. Another disadvantage in case of clockworks with only one motor is the long setting time required. The electrically activated driving arrangements of such clockworks will be designed for the driving power required for moving the pointers. In case the pointers move more rapidly during the setting procedure, a higher driving power is required. In order to avoid too large a driving device, the speed during the setting procedure has to be limited, e.g. to a motion sixteen times higher than the usual speed. This means to set time by one hour would take almost four minutes in case of a single-motor clockwork. A further speed increase is impossible as a braking at the detected starting position would not be possible due to the pointer's inertia moment.

For example, if the pointers are in the 2 o'clock position at restarting, it takes 37 minutes in case of a single-motor clockwork for moving the pointers in the position where the pointer position will be detected.

Performing the recognition of the pointer position also results in battery capacity problems. During the procedure of recognizing the pointer position, the light-emitting diodes of the light barriers have to be supplied with electrical energy in regular, short intervals. This energy has to be taken from the battery, resulting to a rapid exhaust of the relatively expansive battery, in particular in case of wrist watches. But also in case of other clocks, e.g. alarm clocks or wall clocks, the recognition of the pointer position requires a lot of battery power.

Therefore it is the task of the present invention to provide a clockwork, offering a space-saving and inexpensive design on the one hand and providing nevertheless on the other hand a reliable setting of the current time, consuming only few energy. Furthermore it is the task of the invention to provide a procedure for operating such a clockwork.

As provided for by this invention this task is solved by a clockwork according to claim 1.

The procedure as provided for by this invention is the object of claim 8.

The preferred use of such a clockwork is the object of the claims 12 to 14.

The preferred embodiments of the invention are object of the sub-claims.

The invention serves to drastically reduce the design for building an analog display radio-controlled clock. The design as provided for by this invention does no longer require an arrangement for recognizing the pointer position, not even in case of a single-motor clockwork.

The pointers will be moved into a predetermined position by a mechanical device to be actuated by the user. For example, this may be the 12 o'clock position of all pointers. However, the starting position of the pointers will preferably be chosen variably, i.e. such that it corresponds to the past full hour. However this variant presupposes that the user has another clock, giving at least an approximate time.

By the fact that the pointers can be moved to the starting position by the user, the time for setting the clock will be decisively reduced.

In addition it is not necessary to provide an arrangement for recognizing the pointer position. The constructional design of the clockwork is thus considerably reduced and the energy consumption is considerably lessened.

In case a variable starting position of the pointers is chosen, as in case of the preferred emodiment, corresponding to the past full hours, the setting times, required by the clockwork to move the pointers from this starting position into the instantaneous position is considerably reduced and amounts to a maximum of five minutes.

According to a particularly preferred embodiment, the clockwork as provided for by this invention includes three pointers. In this case preferably two externally accessible setting arrangements for the pointers are provided. The first setting arrangement for the second pointer includes an electric switch, operating the driving arrangement temporarily. Thus it is possible to move the second pointer by means of the driving arrangement electrically to the starting position, preferably to the 12 o'clock position. If this is carried out e.g. at a speed four times the usual turning speed, this setting takes less than 15 seconds. Subsequently the user moves the hour and minute pointer into the predetermined position.

This embodiment example has the advantage that the normally toothed connection between the driving arrangement and the second pointer for setting the clock has not to be interrupted.

Alternatively a mechanic adjustment arrangement for the second pointer may be provided.

Further advantages, features and application possiblities of the present invention may be taken from the subsequent description of an embodiment example with regard to the drawing.

Figure 1:
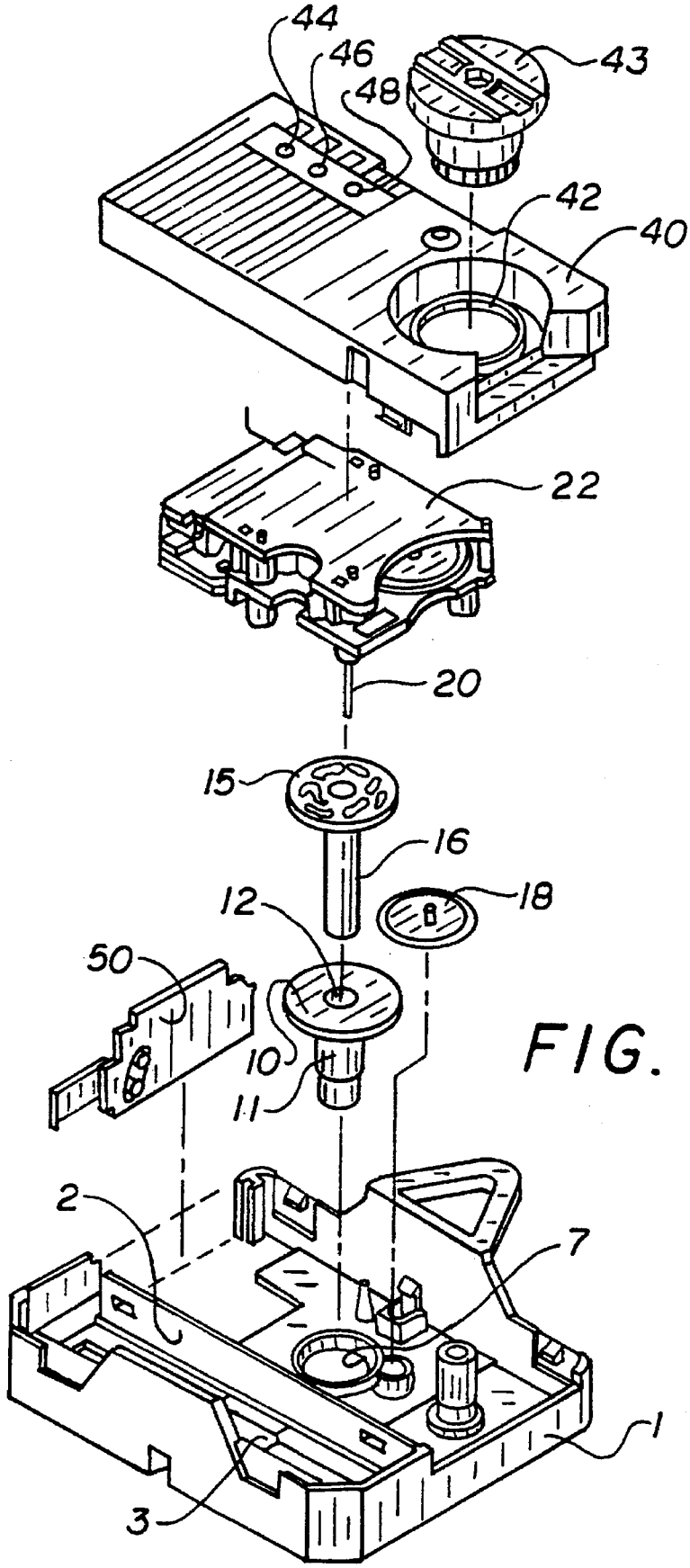
FIG. 1 shows an explosion view of a clockwork as provided for by the invention, however the pointers are not shown.
Figure 2:
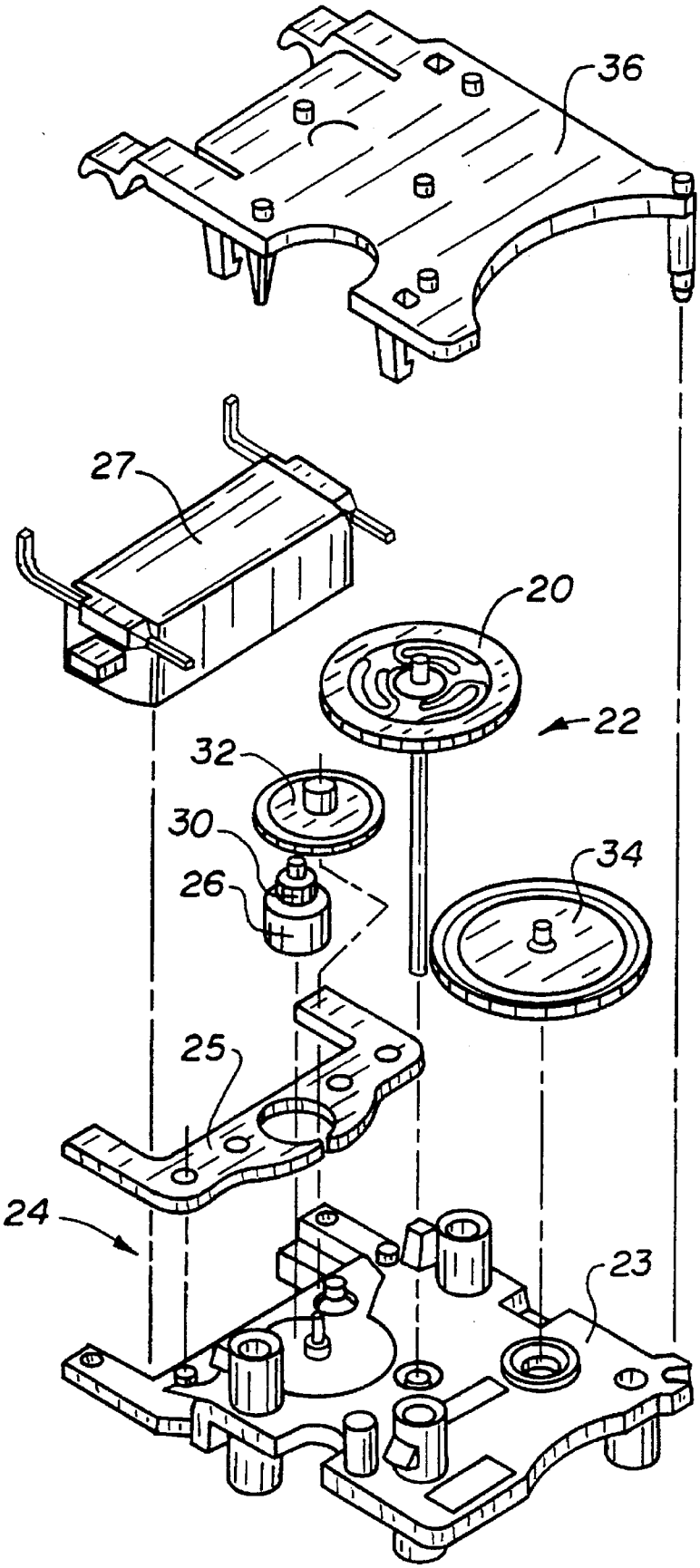
FIG. 2 shows an explosion view of the drive as is used in the clockwork according to FIG. 1.

An embodiment example of the clockwork according to the invention is described with regard to FIG. 1 and 2, for clarity reasons however, the pointers are not shown.

The clockwork shown includes a housing 1 made of plastic material, in which a compartment 3 for a standard battery is provided by a housing wall 2.

In the bottom of housing 1 a bore 7 is provided, into which the plastic hour wheel 10 will be inserted during assembly, including a cylindrical hollow nose 11 on to which the hour pointer will be put.

The minute wheel 15 will be inserted into the longitudinal bore 12 of the hour wheel, having also a cylindrical hollow nose 16, penetrating the cylindrical hollow nose 11 of the hour wheel, upon which the minute pointer will be placed. For transmitting the rotary movement from minute wheel 15 to hour wheel 10 an intermediate wheel 18 is provided, the transmission ratio is 1:60.

If assembled, the shaft of the second wheel 20, arranged in a separately pre-assembled part, clockwork 22, engages into the cylindrical hollow nose 16 of the minute wheel.

As can be seen in FIG. 2, the clockwork 22 includes a fixing plate 23, holding an electric drive 24, consisting of a stator arrangement 25, a rotor 26 and a coil 27.

A toothed wheel 30 is arranged on rotor 26, concentric to it, transmitting the rotary movement of the rotor via the intermediate wheels 32 and 34 to the second wheel 20. A cover plate 36 holds the parts of the clockwork in the assembled condition.

The design of such a clockwork as described so far is known to everybody skilled in the art from the standard quartz clockworks and therefore it must not be detailed.

Housing 1 is closed with cover 40 on the side opposite to the clockface. There is an opening 42 in this cover 40, where a setting wheel 43 for setting the minute pointer and the hour pointer is provided.

In the cover there is a 1st electric switch 44, a 2nd electric switch 46 and a 3rd electric switch 48, the function of these switches is described below.

Figure 3:
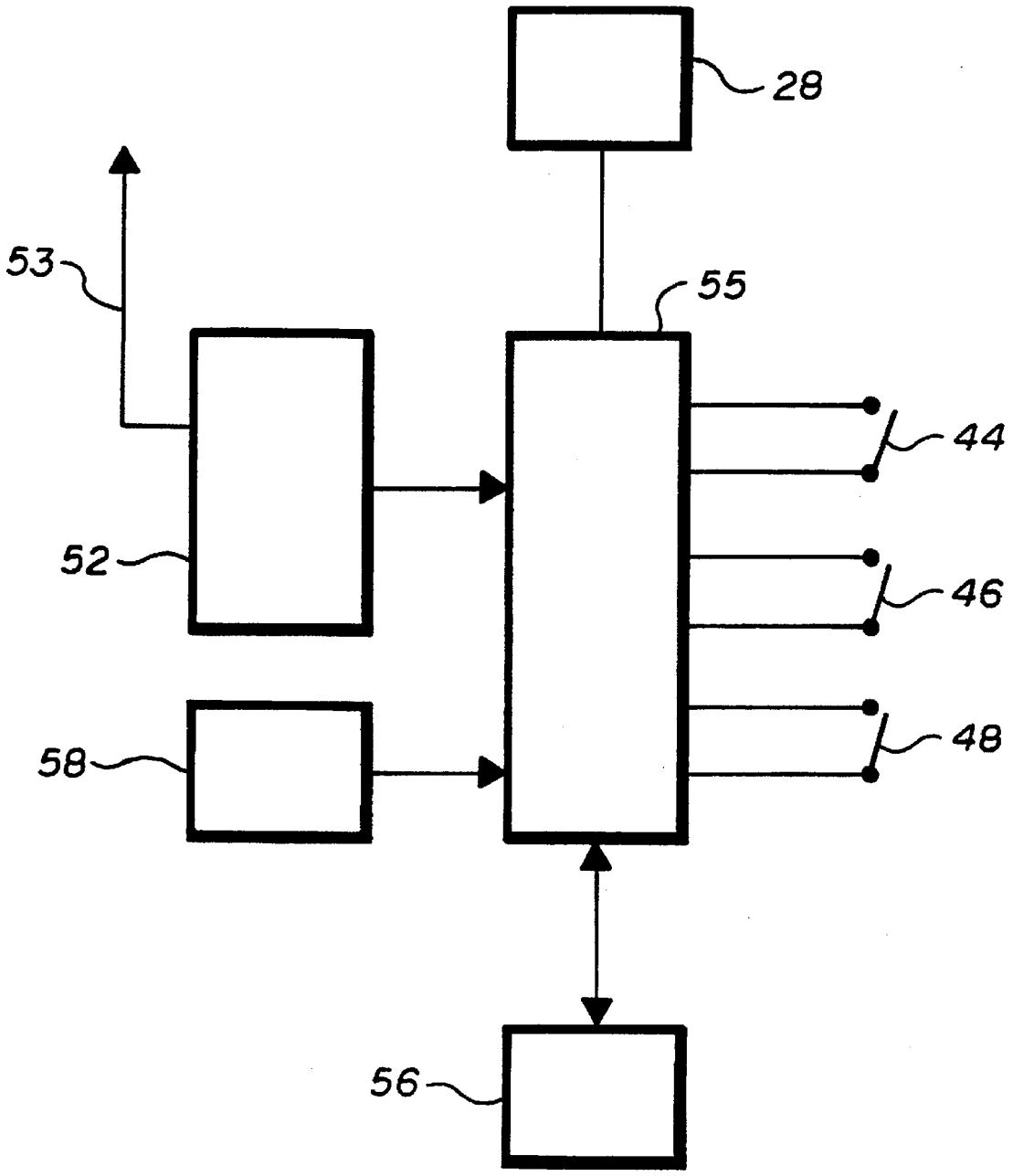
FIG. 3 shows an electronic component for controlling the clockwork.

The control of the clock is performed via an electronic component 50, its design will be detailed with regard to FIG. 3. The electronic component includes a radio receiver unit 52, connected with an antenna 53. The radio receiver unit is designed to receive the signals of a transmitter, sending the time signals.

The time sender used in the Federal Republic of Germany transmits time signals every second. In addition a so-called time telegram will be transmitted, stating date and time.

The design of such a radio receiver unit is prior art and need not be detailed.

The signals of the radio receiver unit will be transmitted to a control device 55, i.e. a conventional microprocessor. The control device 55 will be controlled by a program stored in a memory 56.

In addition the arrangement includes a quartz control 58, in order to be able to operate the clock if no signals can be received from the time transmitter.

It has to be pointed out that one or more of the above mentioned components, e.g. the control device 55 and the memory 56 may be combined to one component.

The first electric switch arrangement 44, the second switch arrangement 46 and the third electric switch arrangement 48 are also connected to the microprocessor.

In the following paragraphs the function of this clockwork will be explained:

In the course of the usual function of the clock the radio receiver unit 52 receives the signals from the time transmitter and passes them on to the microprocessor 55. The microprocessor emits adequate impulses, controlling the driving arrangement 28. The emission of an impulse always means that the rotor 26 makes a full or a half circle depending on its design. Thus the second wheel 20 moves forward clockwise by 6°. The rotary movement of the second wheel will be transmitted to the minute wheel and the hour wheel with the corresponding reduction.

At the first operation of the clock or after an interruption, e.g. when changing the batteries, the clock has to be adjusted. The embodiment example presents two different possibilities for this adjustment, depending on the position of switch 48. In the first alternative the second and the minute pointer will be set to "12" and the hour pointer will be set to the time, corresponding to the full past hour. If the time to be set is e.g. 5.30 h, the clock will be set to 5.00 h.

In the second alternative, all pointers will be set to "12".

The setting of the second pointer will be performed by the electric switch 44. If the switch is activated, the microprocessor emits a rapid signal sequence to the driving arrangement 28, inducing it to a quick forward motion of the second pointer. As soon as the second pointer reaches the position 12.00 h, switch 44 will be put back into its starting position and the second pointer will be held in this position.

Subsequently the minute and hour pointer will be put into the 12.00 h position or into the position of the preceding full hour, corresponding to the position of switch 48. This will be done mechanically by the user via setting wheel 43. As soon as the pointers are in the correct starting position, switch 46 will be actuated, emitting a start signal to processor 55, starting the time setting procedure.

The control device now waits until it has received the first time telegram from the radio receiver arrangement 52. If the control device works according to the first alternative, it calculates the time difference between the 12.00 h position and the instantaneous time and thus the number of impulses required to move the clock to this time. Subsequently the impulses required will be emitted in rapid sequence, e.g. four impulses per second, such that the setting procedure for one hour amounts all in all to 15 minutes. The impulses will be counted and the processor uses them as standard for recognizing the pointer position. As the time elapses during the adjustment procedure, the number of impulses required for getting from the original pointer position to the instantaneous time, has to be adapted adequately. The setting procudure is continued until the instantaneous time is reached.

In case the second alternative is used, the processor assumes that the pointers are in a position, corresponding to the last past full hour. Here too the difference between the instantaneous time and the time given by the pointer position is taken and a number of impulses will be applied to the clockwork to bring the pointers into the required position of the instantaneous time.

The advantage of the first alternative is that no reference time is required, as the whole setting proceeds from a fixed pointer position, i.e. e.g. 12.00 h. However, the disadvantage is that the setting may take very long. As clockworks of the type discussed here normally run only in one direction, i.e. forward, the setting times will be long.

The disadvantage of the second alternative is that the approximate instantaneous time has to be known. However, the advantage lies in a very short setting time. If e.g. sixteen impulses per second are used for the setting procedure, this means that the maximum setting time in this alternative is only about 5 minutes.

Three electrical switches 44, 46 and 48 are provided in the above described first embodiment example. In a simplified second embodiment example the switch 48 will be dropped. In this embodiment example preferably the setting method proceeding from the setting of the past full hour will be used. As detailed above, this offers the advantage of short setting times. The disadvantage, presupposing that the approximate time has to be known, is of no importance as compared to this, as the time normally should be available in areas where such time transmitters have been installed.

In a third embodiment example the electric switching arrangement 44, setting the second to 12.00 h, will be dropped. In this embodiment example the setting of the second will be performed by the user by means of a mechanic setting device. In order to accelerate the setting, even two setting devices may be provided, the first acting on the minute and hour pointer and the second only on the second pointer.

In a third embodiment example all electric switching arrangements will be dropped. In this embodiment example the clockwork comprises only one or two mechanical setting devices, used for setting the desired predetermined time, preferably the past full hour. For preventing the clock's operation during the setting procedure, the battery is to be removed. As soon as the pointers are set to the predetermined value, the battery will be inserted again and the clock starts as soon as the control device receives the signal for the full minute from the radio receiver arrangement.

The advantage of this embodiment example is its extremely simple design.

The above mentioned embodiment examples of the clockwork as provided for by this invention may be used in various clocks, i.e. in wall clocks, grandfather's clocks, alarm clocks and wristwatches.

The model may be chosen depending on the space and battery capacity available and the operating ease of one of the above mentioned embodiment examples.

In case it is used as an alarm clock, the clockwork as provided for by this invention may be coupled with a conventional mechanical alarm release. Furthermore it is possible to couple the alarm clock with an electronic alarm release. However, in this case a LCD display has to be provided to be able to set and display the alarm clock.

In case the clockwork as provided for by this invention is installed in a wristwatch, the winding button is used as mechnical time setting device. Switch 46 is then designed as switch, actuated by disengaging and re-engaging the winding button. In this case the clock begins to run as soon as the button is put in again.

As detailed above, in all embodiment examples preferably a quartz clockwork is used, giving off control signals to the control device, permitting a time control if no radio signal is available or if the radio signal temporarily cannot be received. In a further development of the invention, which can be combined with all above mentioned embodiment examples, the control device in principle processes the signals coming from the quartz arrangement. In this case the radio receiver arrangement will only be activated in predetermined time intervals, e.g. once per hour, to synchronize the time displayed according to the time received and to correct time, if required. The advantage of this embodiment example lies in the fact that the energy consumption will be further decreased, this being of special interest for wristwatches and alarm clocks.

In addition the use of a quartz clockwork offers the advantage that it may be used for calculating the time period since begin of the setting procedure. This is important in case the radio clock does not receive a signal for a longer period of time at begin of the setting procedure. If the instantaneous time is e.g. 10.55 h, the user has to set as starting time for the pointer setting 10.00 h. In case it takes 10 minutes until the first radio signal will be received and a setting of the pointer position becomes possible, e.g. due to a temporary disturbance, the clock would assume a pointer position of 11.00 h und thus the pointer would only be moved by 5 minutes with regard to the starting position. However, this would result in a faulty display of 1 hour.

However, if the quartz clock is used for checking the duration of the setting procedure, the processor can calculate that the predetermined pointer position has been set on 10.55 h. The control device 55 is then able to determine that the preset pointer position is 10.00 h and cause an adequate pointer movement.

What is claimed is:

1. A radio-controlled analog display clockwork with:

at least two pointers, a current source, a driving arrangement (24), driving the pointers, a mechanical pointer setting arrangement (43, 44, 46) for bringing the pointers into a predetermined starting position, corresponding to a certain time, a control device (55) supplying control signals for controlling said driving arrangement, a radio receiver arrangement (52), receiving time signals from a time transmitter and passing them on to the control device (55), said current source, said driving arrangement, said control device and said radio receiving arrangement being arranged in one common housing, characterized in that said mechanical pointer setting arrangement is to be actuated by the user, and thereafter the control device applies control signals to the driving arrangement on the basis of said predetermined starting position, resulting in an increased pointer speed, until a pointer position corresponding to the instantaneous time is reached.

2. A clockwork according to claim 1, characterized in that said predetermined starting position cannot be changed.

3. A clockwork according to claim 2, characterized in that said predetermined starting position can be changed depending on the relevant instantaneous time.

4. A clockwork according to claim 2, characterized in that a switching arrangement (48) is provided, permitting the arrangement to be switched from a first setting alternative, where the predetermined starting position is fixed, to a second setting alternative, where the predetermined starting position depends on the instantaneous time.

5. A clockwork according to claim 3, characterized in that a switching arrangement (48) is provided, permitting the arrangement to be switched from a first setting alternative, where the predetermined starting position is fixed, to a second setting alternative, where the predetermined starting position depends on the instantaneous time.

6. A clockwork according to claim 3, characterized in that the predetermined starting position dependent on the instantaneous time, corresponds to the past full hour of the instantaneous time.

7. A clockwork according to claim 4, characterized in that the predetermined starting position dependent on the instantaneous time, corresponds to the past full hour of the instantaneous time.

8. A clockwork according to claim 5, characterized in that the predetermined starting position dependent on the instantaneous time, corresponds to the past full hour of the instantaneous time.

9. A clockwork according to claim 1, characterized in that a third pointer is provided, designed as pointer for the seconds and that a first switching arrangement (44) is provided, permitting the second pointer to be switched to an increased rotary speed by means of the driving arrangement (28), in order to move said second pointer into said predetermined starting position.

10. A clockwork according to claim 1, characterized in that a 2nd switching arrangement (46) is provided, permitting the user to start the time setting procedure, performing the movement of the pointers from the predetermined starting position to the pointer position corresponding to the instantaneous time.

11. A radio-controlled clockwork according to claim 1, said clockwork being the clockwork within a wall or Grandfather's clock.

12. A radio-controlled clockwork according to claim 1, said clockwork being the clockwork within an alarm clock.

13. A radio-controlled clockwork according to claim 1, said clockwork being the clockwork within a wristwatch.

14. A procedure for setting an analog display radio clockwork said clockwork comprising at least two pointers, a current source, a driving arrangement (24), driving the pointers, a mechanical pointer setting arrangement (43, 44, 46) for bringing the pointers into a predetermined starting position, corresponding to a certain time, a control device (55) supplying control signals for controlling said driving arrangement, a radio receiver arrangement (52), receiving time signals from a time transmitter and passing them on to the control device (55), said current source, said driving arrangement, said control device and said radio receiving arrangement being arranged in one common housing, said mechanical pointer setting arrangement is to be actuated by the user, and thereafter the control device applies control signals to the driving arrangement on the basis of said predetermined starting position, resulting in an increased pointer speed, until a pointer position corresponding to the instantaneous time is reached, a second switching arrangement (46) being provided in said clockwork, permitting the user to start the time setting procedure, performing the movement of the pointers from the predetermined starting position to the pointer position corresponding to the instantaneous time, said procedure for setting said analog display radio clockwork being characterized by the following procedure steps:

stopping the clockwork, such that the pointers do no longer move, moving the pointers into a predetermined starting position by a setting wheel (44) to be actuated by the user, starting the setting procedure with an electric switching device (46), fixing the instantaneous time by evaluating the time signals received from a radio receiver by means of said control device, moving the pointers at an increased speed out of said predetermined starting position, counting the number of current impulses, supplied to said driving arrangement for pointer movement, comparing the number of impulses emitted with the number of impulses required for reaching the instantaneous time, terminating the setting procedure, as soon as the number of impulses has been put out, required for moving the pointers into a position corresponding to the instantaneous time, continuation of the normal clockwork operation.

15. A procedure according to claim 14, characterized in that said predetermined starting pointer position is predetermined invariably.

16. A procedure according to claim 14, characterized in that the predetermined starting pointer position depends on the instantaneous time.

17. A procedure according to claim 14, characterized in that a pointer for the seconds is provided, electrically transferable to said predetermined pointer starting position by means of the driving arrangement.

18. A procedure according to claim 15, characterized in that a pointer for the seconds is provided, electrically transferable to said predetermined pointer starting position by means of the driving arrangement.

19. A procedure according to claim 16, characterized in that a pointer for the seconds is provided, electrically transferable to said predetermined pointer starting position by means of the driving arrangement.

* * * * *